United States Patent [19]

Bucheder

[11] 4,411,078

[45] Oct. 25, 1983

[54] DEVICE FOR CLOSING A SLOT IN AN UPPER OR GAITER OF A SKIING BOOT

[75] Inventor: Erwin Bucheder, Köflach, Austria

[73] Assignee: Koflach Sportgerate Gesellschaft, Köflach, Austria

[21] Appl. No.: 291,078

[22] Filed: Aug. 7, 1981

[30] Foreign Application Priority Data

Aug. 28, 1980 [AT] Austria ..... 4365/80

[51] Int. Cl.[3] ..... A43B 5/04; A43B 11/00

[52] U.S. Cl. ..... 36/117; 36/50; 128/68 SK; 128/69 SK

[58] Field of Search ..... 36/50, 53, 60, 117, 36/121, 122, 138; 24/68 SK, 248 E, 258, 69 SK

[56] References Cited

U.S. PATENT DOCUMENTS 3,118,203 1/1964 Forrester ..... 24/68 SK 4,121,359 10/1978 Bertetto ..... 36/50

FOREIGN PATENT DOCUMENTS 604186 4/1926 France ..... 24/258

*Primary Examiner*—Werner H. Schroeder

*Assistant Examiner*—Steven N. Meyers

*Attorney, Agent, or Firm*—Cushman, Darby & Cushman

[57] ABSTRACT

To permit the closing of a slot (3) in an upper or gaiter (2) of a skiing boot, the confronting edge portions (4) defining the slot (3) carry outwardly protruding cams (5), which are formed with bearing holes (7), in which a U-shaped fastener (8) is pivoted on an axis that is transverse to the longitudinal axis of the slot (3). The confronting side faces of the legs (11) of the fastener (8) are adapted to cooperate with the outside surfaces (6) of the cams. Said outside surfaces (6) consist of inclined or helical surfaces so that the fastener (8) can be pivotally moved to approach the opposite edges (4) of the slot to each other.

6 Claims, 4 Drawing Figures

DEVICE FOR CLOSING A SLOT IN AN UPPER OR GAITER OF A SKIING BOOT

Figure 1:
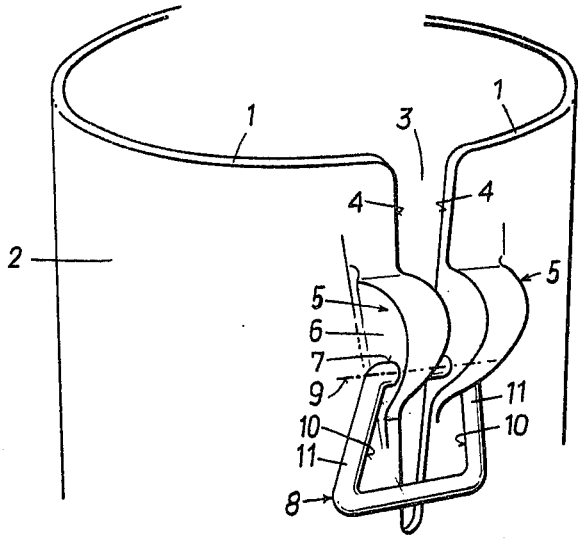

This invention relates to a device for closing a slot in an upper or gaiter of a skiing boot, which slot may be particularly disposed near the Achilles tendon. The opening of such slot will permit the wearer of the boot to stand or walk more comfortably. As the slot is closed, the skier's leg is given the forward lean required for downhill skiing. Conventional buckles have been provided to close such slots. It is also known to provide a clip, which embraces the edges of the slot and is slidable along the same like the slider of a slide fastener so that the edges of the slot are forced together. In dependence on the elevation of the clip the slot can be elastically opened to a larger or smaller extent.

It is an object of the invention to provide a particularly simple and stable device which is of the kind described first hereinbefore and which permits the slot to be reliably closed and to be opened in a simple manner and with a small effort. In a device of the kind described first hereinbefore this object is accomplished in that in accordance with the invention the mutually opposite edge positions defining the slot carry outwardly protruding cams formed with bearing holes, a U-shaped fastener is pivoted in said bearing holes on an axis which is transverse to the longitudinal axis of the slot, and the cams have inclined surfaces which face away from the slot and are adapted to cooperate with the confronting side faces of the legs of the fastener. With this device, the slot can be opened and closed simply by a pivotal movement of the U-shaped fastener. The slot can be opened, e.g., in a simple manner by means of the ski pole. For this purpose the web which connects the legs of the fastener has preferably an offset portion which in the closing position preferably protrudes outwardly from the plane that is defined by the legs.

In dependence on the taper or lead of the inclined surfaces, a relatively short movement of the fastener is sufficient to close the slot in the upper or gaiter as is required for downhill skiing. The thickness of the cams measured in the direction which is transverse to the longitudinal direction of the slot preferably increases toward the upper edge of the upper or gaiter. This feature will ensure that there is a sufficiently large cross-section of material so that relatively strong forces can be taken up without a danger of a deformation or fracture. The taper or lead of the inclined surfaces may be selected so that the fastener will be self-locking. In a preferred embodiment, the taper or lead of the inclined surfaces is smaller in the end portion near the upper edge of the upper or gaiter than in the remaining portions. This will ensure that even strong impacts on the boot will not cause the fastener to assume an open position, in which the foot will no longer be reliably held in the skiing boot. A high safety against an inadvertent opening can be provided if a notch for locking the fastener is provided in the upper portion of the cams near the upper edge of the upper or gaiter.

In order to ensure that the U-shaped fastener will exert the required pressure forces on the helical surfaces even when the material of the fastener is relatively small in cross-section, e.g., when the fastener consists of a U-shaped wire member, means can be provided for holding the fastener in the bearing holes against a displacement in the direction of the pivotal axis.

Figure 2:
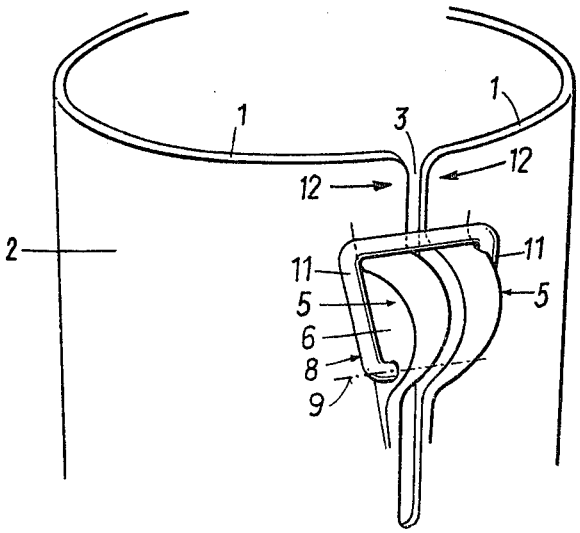
Figure 3:
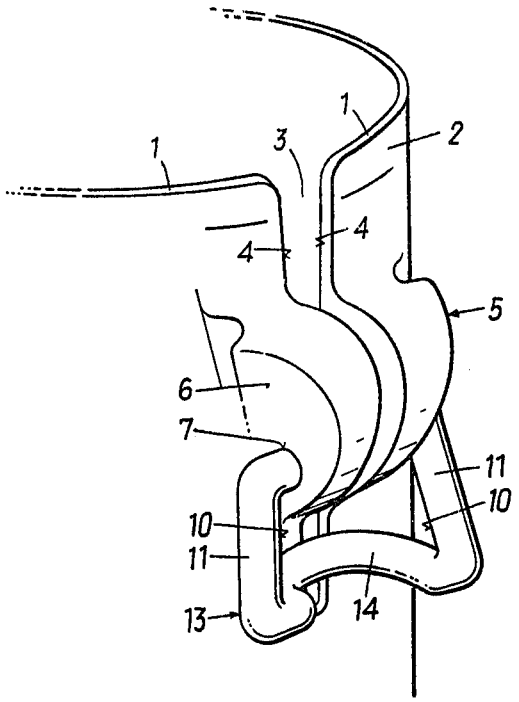
Figure 4:
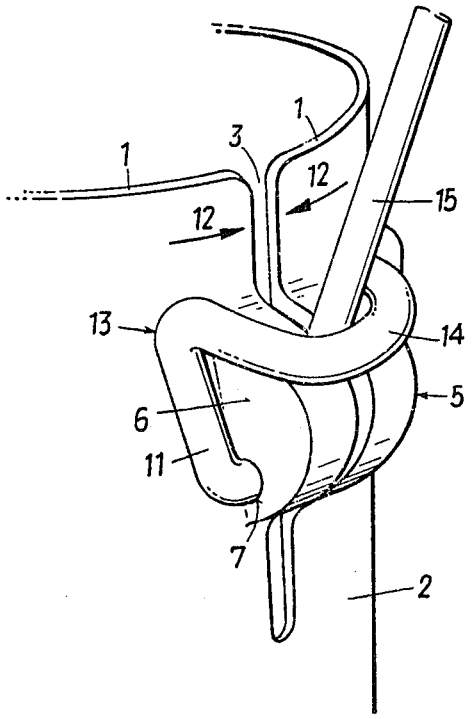

The invention will now be described more in detail with reference to embodiments shown by way of example on the drawing, in which FIGS. 1 and 2 are perspective views showing a first embodiment of the device according to the invention in opened and closed positions and FIGS. 3 and 4 are perspective views showing another embodiment in opened and closed positions.

FIGS. 1 and 2 show the upper edge 1 of a gaiter 2. A slot 3 extends downwardly from the edge 1 and has edge positions 4. The gaiter is integrally formed at said edge positions 4 with cams 5, which have inclined surfaces 6 facing away from the edges 4 of said slot 3. Each cam 5 has a bearing hole 7, in which a substantially U- or C-shaped fastener 8 of steel wire is pivoted on an axis 9. When the fastener 8 is swung down, as shown in FIG. 1, the confronting side faces 10 of the legs 11 of the fastener 8 are disengaged from the inclined surfaces 6 of the cams 5.

In the position shown in FIG. 2 the fastener 8 has been turned upwardly to close the slot 3. In this position the legs 11 of the fastener cooperate with the inclined surfaces 6 of the cams 5 so that the slot 3 is reduced in width in the sense indicated by the two arrows 12.

In the embodiment shown in FIGS. 3 and 4, the gaiter or the upper portion of the upper is designated by the same reference characters as in FIGS. 1 and 2. The U-shaped fastener 13 differs from the U-shaped fastener 8 shown in FIG. 1 in that the web 14, which connects the two legs 11 has an offset portion, which in the closed position shown in FIG. 4 protrudes from the plane that is defined by the legs 11. With that design, the offset web 14 can be engaged by an end portion 15 of a ski pole so that the fastening device can be conveniently opened in that the fastener 13 is turned from the closing position shown in FIG. 4 to the open position shown in FIG. 3.

What is claimed is:

1. A device for closing a slot in an upper or gaiter of a skiing boot, characterized in that the mutually opposite edge portions defining the slot carry outwardly protruding cams, which are formed with bearing holes, a U-shaped fastener is pivoted in said bearing holes on an axis that is transverse to the longitudinal axis of the slot, and said cams have inclined surfaces which face away from the slot and are adapted to cooperate with the confronting side faces of the legs of the fastener.

2. A device according to claim 1, characterized in that the thickness of the cams, measured in the direction which is transverse to the longitudinal direction of the slot, increases toward the upper edge of the upper or gaiter.

3. A device according to claim 1 or 2, characterized in that the taper or lead of the inclined surfaces is smaller in the end portion near the upper edge of the upper or gaiter than in the remaining portions.

4. A device according to claim 1, characterized in that the cams are formed with a notch for locking the fastener in that end portion of the cams which is near the upper edge of the upper or gaiter.

5. A device according to claim 1, characterized in that the web which connects the legs of the fastener has an offset portion which in the closed position protrudes outwardly from the plane defined by the legs.

6. A device as in claim 1 wherein the slot is disposed near the Achilles tendon of the wearer.

* * * * *